United States Patent [19]

Olsson

[11] Patent Number: 4,600,259

[45] Date of Patent: Jul. 15, 1986

[54] ELECTRICAL TERMINAL HAVING WIRE-RECEIVING SLOT FOR RELATIVELY SMALL DIAMETER WIRES AND CONNECTORS CONTAINING SUCH TERMINALS

[75] Inventor: Billy E. Olsson, New Cumberland, Pa.

[73] Assignee: AMP Incorporated, Harrisburg, Pa.

[21] Appl. No.: 704,458

[22] Filed: Feb. 22, 1985

[51] Int. Cl.[4] ..... H01R 4/24

[52] U.S. Cl. ..... 339/99 R

[58] Field of Search ..... 339/97 R, 97 P, 98, 339/99 R

[56] References Cited

U.S. PATENT DOCUMENTS 3,958,853 5/1976 Wilson ..... 339/99 R
4,153,324 5/1979 Kukla ..... 339/97 R
4,262,984 4/1981 Takahashi ..... 339/97 R
4,466,681 8/1984 Meindl ..... 339/97 R

*Primary Examiner*—Joseph H. McGlynn
*Attorney, Agent, or Firm*—F. W. Raring

[57] ABSTRACT

Electrical terminal having a wire-receiving slot comprises a pair of plate-like members in parallel side-by-side relationship. The plate-like members have aligned free ends and the space between the plate-like members serves as the wire-receiving slot for a wire which is to be connected to the terminal. The width of the slot is substantially less than the thickness of the material of the plate-like members and the terminal can be produced in sizes which are suitable for extremely fine wires having diameters of 0.2 mm or less. A connector is described containing terminals in accordance with the invention.

12 Claims, 12 Drawing Figures

ELECTRICAL TERMINAL HAVING WIRE-RECEIVING SLOT FOR RELATIVELY SMALL DIAMETER WIRES AND CONNECTORS CONTAINING SUCH TERMINALS

FIELD OF THE INVENTION

This invention relates to electrical terminals having a wire-receiving slot for establishing contact with a wire inserted into the slot and to electrical connectors containing terminals having wire-receiving slots. The invention is particularly concerned with terminals which are intended for use with extremely fine wires.

BACKGROUND OF THE INVENTION

U.S. Pat. No. 3,444,506 describes a multicontact electrical connector for flat cable having contact terminals therein which have wire-receiving slots into which the conductors of the cable are inserted when electrical contact is made. The terminals are of flat conductive sheet metal and have a free end into which the wire-receiving slot extends. The width of the slot is less than the conducting cores of the conductors so that as the conductor moves into the slot, the edges of the slot contact the conductor to form the electrical contact.

Terminals of the type described in the above-identified U.S. patent are widely used for wires having a diameter of at least about 0.33 mm (0.013 inches) which is the equivalent of an AWG 28 wire but they are not used to any significant extent for wires having a diameter less than about 0.33 mm. The reason for this limitation on the use of wire-in-slot or insulation displacement terminals is that it is impractical to produce terminals having extremely narrow slots which are required for very fine wires. For example, an AWG 32 wire has a diameter of about 0.20 mm (0.008 inches) and the slot required for a wire of this size must have a width of about 0.1 mm (0.004 inches). The wire-receiving slots are produced in the sheet metal from which the terminals are manufactured by means of conventional punch and die techniques, that is, a punch is provided having a width equal to the width of the slot and a die is also provided having a opening into which the punch moves. The sheet metal is supported on the die and when the punch moves into the die, the slot is formed.

As a practical matter, it is not possible to produce slots in sheet metal of a given thickness which have a width which is significantly less than the thickness of the sheet metal. In other words, if the stock metal has a thickness of about 0.30 mm, it is impractical to punch a slot in the stock metal having a width which is much less than 0.30 mm. It follows that if the wire has a diameter of 0.20 mm, the slot width should be about 0.10 mm and a slot having this width cannot be produced in stock metal having a thickness of 0.30 mm. This limitation on slot width exists for the reason that if it is attempted to punch an extremely narrow slot in a relatively thick stock metal, the punch will break because of the extremely high stresses imposed on the punch when it moves against the stock metal.

It might appear that the terminals for extremely fine wires might be produced from extremely thin stock metal thereby to permit the formation of extremely narrow slots in the stock metal. However, if the stock metal used for the terminals is extremely thin, the resulting terminals will be flimsy and will be useless for that reason.

U.S. Pat. No. 4,293,177 shows another type of terminal having a wire-receiving slot which is produced by folding a flat piece of sheet metal to produce two side-by-side parallel sections of sheet metal connected by a fold or bight. The edges of the sections are coined and bent inwardly towards each other to define the wire-receiving slots. In the manufacture of this type of terminal it is not necessary to punch the slot and the problems discussed above which are encountered when narrow slots are punched are avoided.

The present invention is directed to the achievement of an improved terminal which comprises a folded section of sheet metal to produce a pair of parallel plate-like members and particularly to a terminal which can be used in connectors intended for flat ribbon cable without stripping insulation from the cable. The invention is further directed to the achievement of terminals which are more compact than previously available terminals and which, for that reason, are desirable for use with extremely fine wires.

THE INVENTION

The invention comprises a sheet metal electrical terminal of the type having a shank portion which has an inner end and a free end. The shank portion has oppositely facing first and second major surfaces and has a wire-receiving slot extending inwardly from the free end. The terminal is characterized in that the shank portion comprises first and second plate-like members which are in side-by-side parallel relationship. The first and second major surfaces are on the first and second plate-like members respectively and the plate-like members have first and second internal surfaces which are opposed to each other. The shank portion has a contact section which extends from a free end towards the inner end, the first and second internal surfaces having opposed contact surface portions in the contact section which are spaced apart by a distance which is less than the diameter of the wire for which the terminal is intended. The wire-receiving slot is thus defined by the space between the first and second internal surfaces of the plate-like members and a wire can be connected to the terminal by aligning the wire with the slot and moving the wire laterally of its axis and into the slot.

In accordance with the further embodiments, the shank portion has first and second side edges and comprises a folded section of flat sheet metal having a U-shaped cross section. The U-shaped cross section thus has a bight and walls extending from the bight. The bight is the first side edge and the walls are the first and second plate-like members. In accordance with a further embodiment, the bight extends from the contact section towards the inner end and does not extend into the contact section.

In accordance with a further embodiment, the opposed contact surface portions extends from a location adjacent to, but spaced from, the free end towards the inner. The first and second internal surfaces are recessed in the contact section from the opposed contact surface portions so that a lead-in portion is provided in the slot to guide the wire into the space between the contact surfaces.

In accordance with a further embodiment, a multicontact electrical connector is provided containing contact terminals as described above.

THE DRAWING FIGURES

FIG. 1 is a perspective view of a terminal in accordance with the invention.

FIGS. 2, 3 and 4 are views looking in the direction of the arrows 2—2, 3—3 and 4—4 of FIG. 1.

Figure 8:
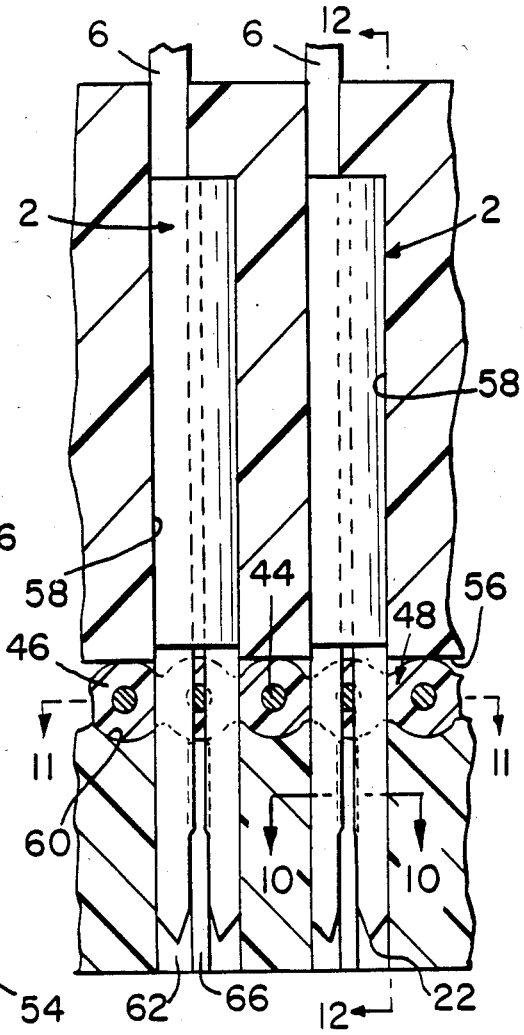
FIG. 8 is a view similar to FIG. 7 but showing the positions of the parts when the connector is installed on the cable and the terminals are in contact with the conductors in the cable.
Figure 9:
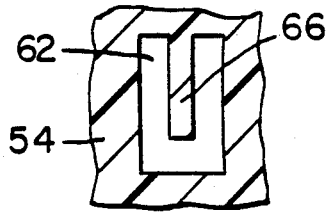
FIG. 9 is a view looking in the direction of the arrows 9—9 of FIG. 7.
Figure 10:
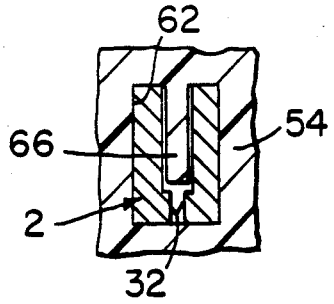
Figure 11:
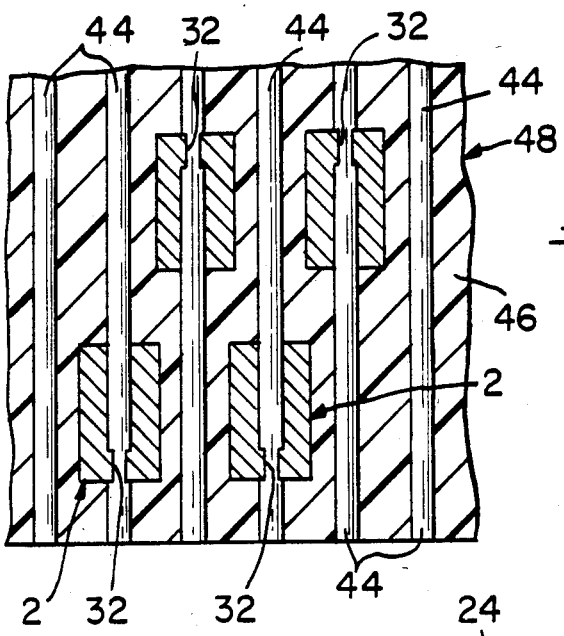
Figure 12:
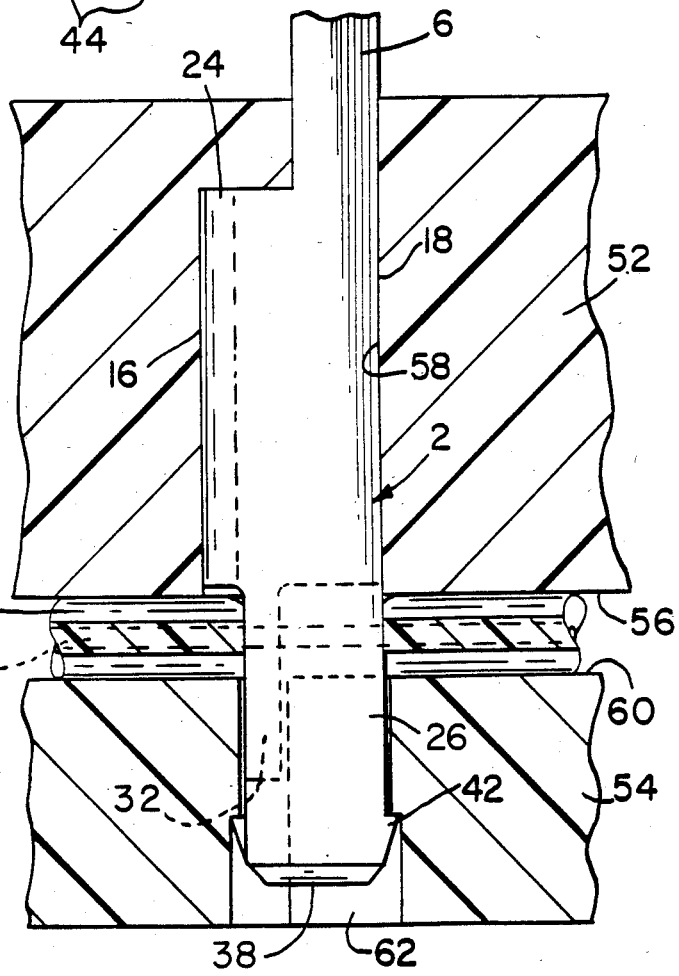

FIGS. 10, 11 and 12 are views looking in the direction of the arrows 10—10, 11—11 and 12—12 of FIG. 8.

THE DISCLOSED EMBODIMENT

One form of terminal 2 in accordance with the invention comprises a shank portion 4 having an arm 6 extending from an inner end 20 of the shank. The arm 6 may take the form of a solder post, for example, or other device for connecting the terminal to a complementary terminal or other conductor.

The shank portion 4 comprises first and second generally rectangular plate-like members 8, 10 which have oppositely facing first and second major surfaces 12, 14. The shank portion has first and second side edges 16, 18 which extend from the inner end 20 to the free end 22 thereof.

Figure 1:
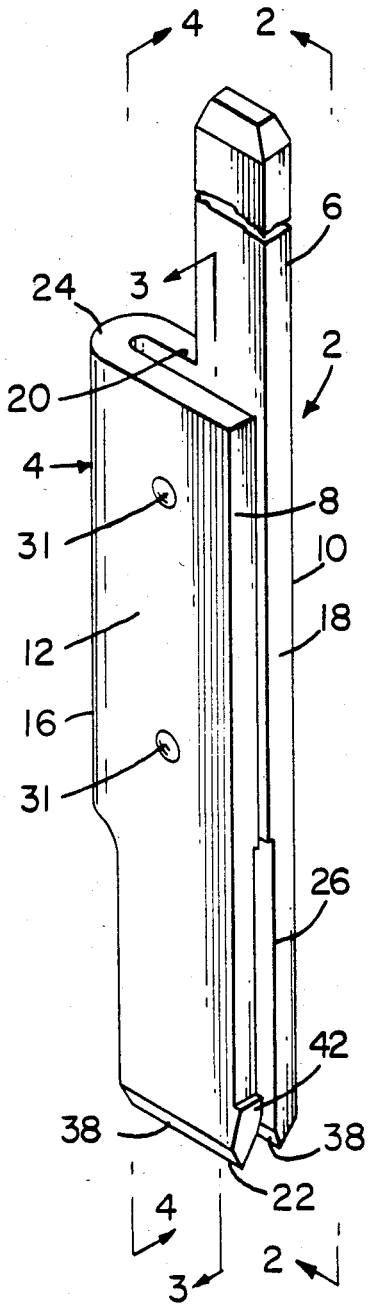

As will be explained below, the terminal is produced by folding a flat blank so that the first side edge 16, has a fold or bight as shown at 24 and the plate-like members 8, 10 are the sidewalls which extend from the bight. The bight 24 has one end, the lower end in FIG. 1, which is spaced from the free end 22 of the terminal. The bight extends from the one end, the lower end in FIG. 1, towards the inner end 20 and the portion of the shank between the bight and the free end 22 can be considered as a contact or conductor-receiving section 26.

Figure 3:
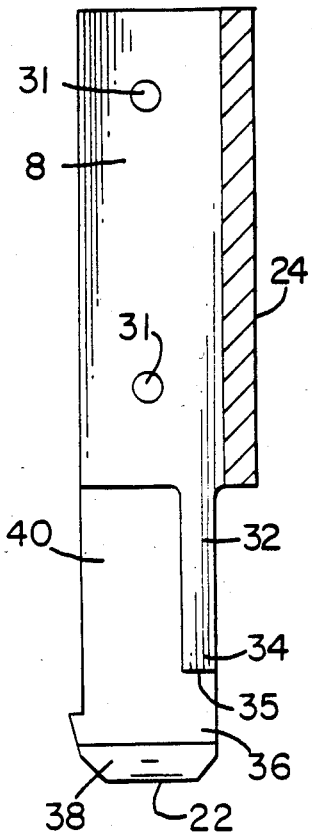
Figure 4:
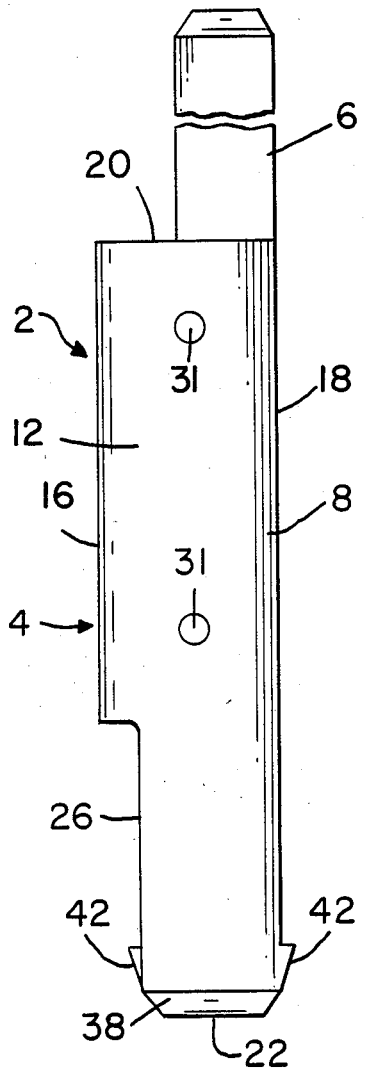

The plate-like members 8, 10 have opposed internal first and second surfaces 28, 30 and, in the contact or conductor-receiving section 26, these internal surfaces have opposed contact surface sections 32 which are on the right-hand side of the terminal as viewed in FIG. 3 so that they are adjacent to the bight 24. The significance of this feature will be explained below.

Figure 2:
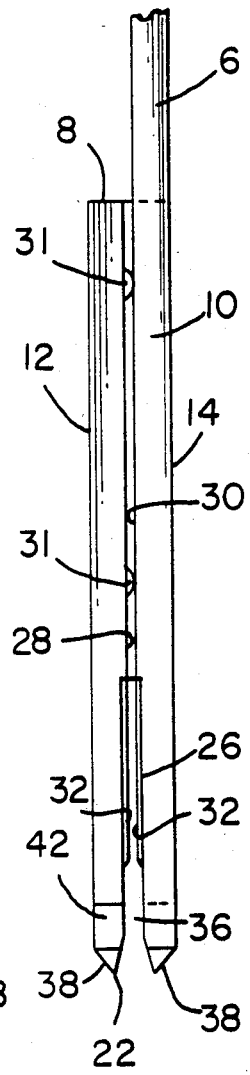
Figure 5:
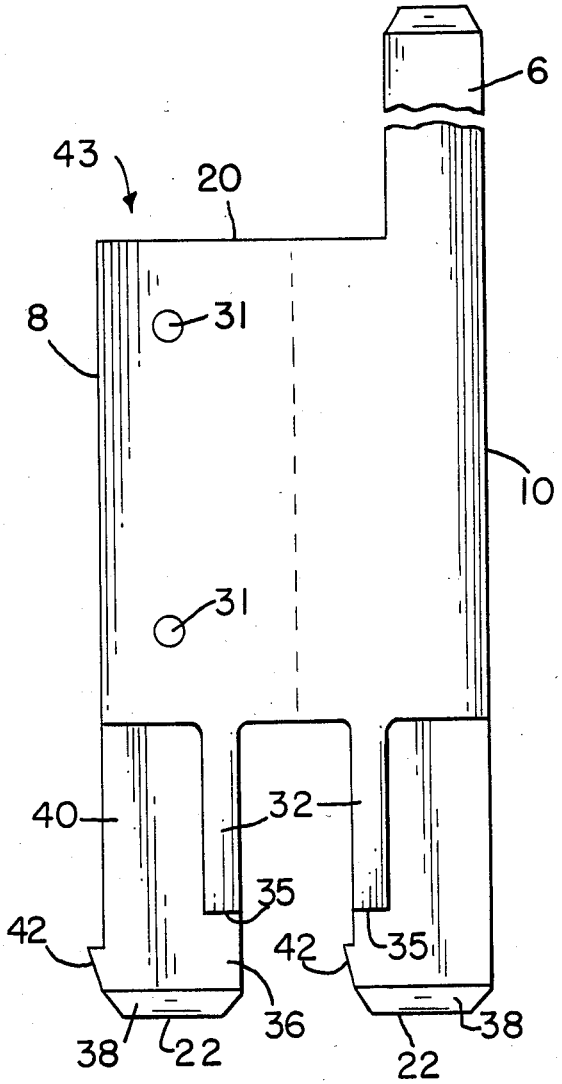
FIG. 5 is a plan view of a flat blank from which the terminal of FIG. 1 is produced.

The wire-receiving slot of the terminal is the space between the opposed plate-like members in the contact section 26 and a wire can therefore be aligned with this slot and moved laterally of its axis into the slot until it is between the opposed contact surface sections 32. It will be noted that the ends of these contact surfaces 32 are spaced from the free end as shown at 34 and the zones 36, 40 which surround the contact surface sections 32 are of reduced thickness as shown in FIG. 2. This reduced thickness is achieved by simply coining the flat blank as shown in FIG. 5 prior to folding of the blank and this coining operation results in the provision of a wire lead-in section as shown at 36 in FIGS. 2 and 3. The distance between the opposed coined surfaces 36 is greater than the thickness of the conductor for which the terminal is extended so that the conductor can be moved easily into the slot until it encounters the end 34 of the contact surface sections 32. It is also desirable to swage the ends of the plate-like members as shown at 38 to thereby provide tapered opposed surfaces at the slot which will guide the wire into the lead-in section 36.

The leading edge 35 of each contact surface section 32 may be made relatively sharp if the wire for which the terminal is intended has a varnish-type insulation (if it is a magnet or coil wire) so that these sharp leading edges will penetrate the varnish-type insulation and establish electrical contact. On the other hand, if the wires are provided with conventional relatively soft plastic insulation, these leading edges 35 should be smooth for best results.

FIG. 5 shows the coined blank 43 from which the terminal of FIGS. 1 to 4 is produced. Ordinarily, a succession of blanks will be stamped from a continuous strip of conductive sheet metal and the finished terminals will be connected to a continuous carrier strip so that the terminals can be removed from the strip by an assembly machine and inserted into a multicontact connector as described below. The blank after being stamped from sheet metal is coined in the areas 36, 40 and swaged as shown at 38. Advantageously, dimples are provided as shown at 31 on one side of the fold line so that when the blank is folded to produce the terminal of FIG. 1, the internal surfaces of the plate-like members will be spaced apart by a precisely predetermined amount and the width of the slot particularly as measured between the contact surface sections 32 is thereby precisely controlled. The blank shown is provided with lances 42 by means of which it is retained in the connector housing shown in FIG. 6.

Terminals in accordance with the invention can be produced in a wide range of sizes for wires of varying diameters however, as noted above, the invention has particular advantages for relatively fine wires. In order to illustrate this advantage, the approximate dimensions of a terminal intended for an AWG 32 wire having a diameter of about 0.20 mm (0.008 inches) will be described.

The terminal is produced from sheet metal having a thickness of about 0.30 mm (0.012 inches), the material preferably being a phosphor bronze in temper 5 or temper 6, that is to say, material which has been work hardened by extensive cold rolling. The blank is stamped as shown in FIG. 5 and the swaging, coining and dimpling operations are carried out to produce the dimples 31, the reduced thickness areas 36, 40 and the lead-in surfaces 38 adjacent to the free end 22. Thereafter, the blank is folded along the fold lines indicated through an angle of 180° until the internal surfaces are against or opposed to each other. The closeness of the opposed surfaces is controlled during manufacturing by the stamping and forming die with the air of the dimples 31 and the distance between the opposed internal surfaces can thus be very closely controlled. In the finished terminal, the distance between the opposed internal surfaces in the coined areas 36, 40 is approximately 0.20 mm (0.008 inches) and the spacing between the opposed contact surface sections 32 is approximately 0.10 mm (0.004 inches). A wire-receiving slot of these dimensions is thus properly dimensioned to receive a wire having a diameter of 0.20 mm. It will be apparent from the discussion previously presented that it would be impossible to produce a slot having this width by conventional stamping operations with a punch and die for the reason that the punch would not withstand the forces developed. The overall length of the shank portion of the terminal described above is about 6.3 mm (0.25 inches) and the width is 1.3 mm (0.05 inches).

A terminal as described above which is manufactured from stock metal having a thickness of 0.30 mm is sufficiently robust to withstand the handling to which it must be subjected when it is manufactured and assembled to an electrical connector. The disclosed form of the terminal is particularly strong in that the folded bight portion 24 of the shank is composed of material which has been severely work hardened by the folding operation. The material itself is preferably in a relatively hard temper and the added folding operation to produce the bight further hardens the material in the zone 24 of the terminal. It will be noted that the contact surface sections 32 are immediately adjacent to and in alignment with the bight 24. The stresses thus imposed on the terminal during insertion of the wire can thus be transmitted to the strongest part of the terminal so that it is able to withstand these forces.

Figure 6:
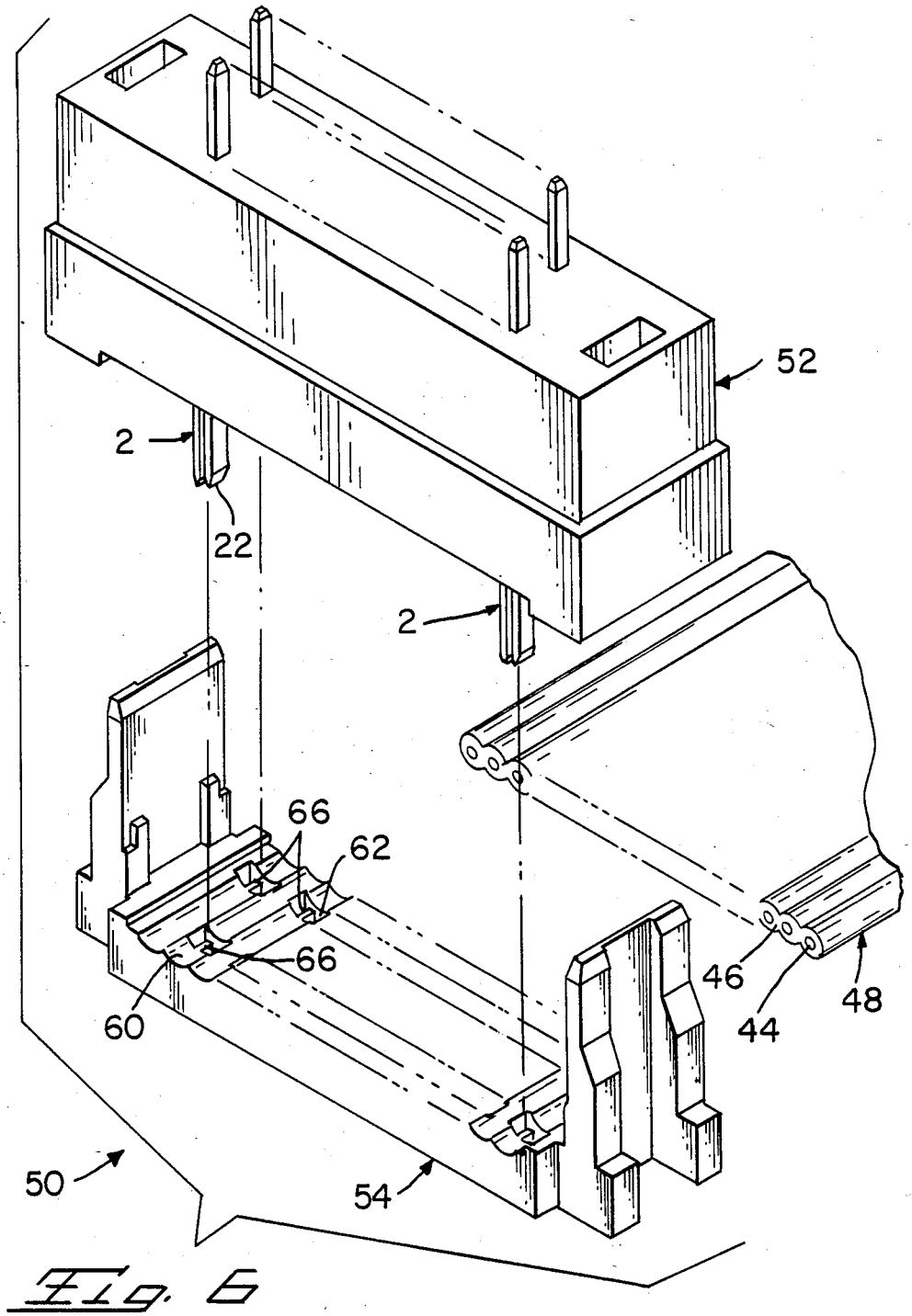
FIG. 6 is a perspective view with parts exploded from each other of a multicontact electrical connector for flat cable having terminals in accordance with the invention.
Figure 7:
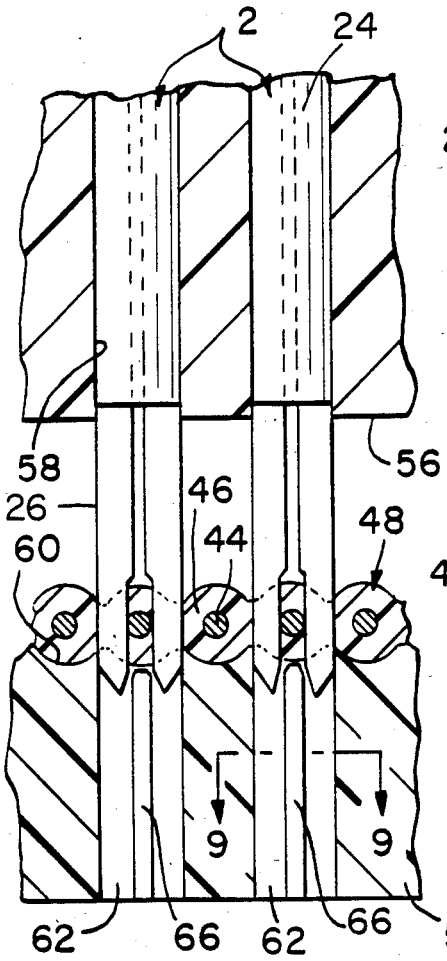
FIG. 7 is a fragmentary sectional view showing the body portion and the cover portion of the connector of FIG. 6 and illustrating the positions of the terminals relative to a cable on which the connector is being installed.

FIG. 6 shows a connector assembly 50 containing terminals in accordance with the invention which is intended to be installed on a multiconductor cable 48 having a plurality of conductors 44 in side-by-side relationship contained in insulating material 46. The connector assembly comprises a housing body 52 and a cover 54 which is assembled to the housing 52 against the conductor-receiving surface 56 thereof. The housing body has a plurality of openings 58 (FIG. 7) which receive the shank portions of the terminals in a manner such that the contact sections 26 extend beyond the surface 56 as shown in FIG. 7. Advantageously, the bight portions of the terminals are recessed slightly from the surface 56 as shown.

The cover 54 has a scalloped surface as shown at 60 for supporting the cable and has a plurality of U-shaped openings 62 which receive the sections 26 of the terminals. Ribs 66 in these openings are dimensioned to be received in the coined zones 40 of the terminals and functions to support the conductor immediately adjacent to the wire contacting surface sections 32 when the wires are being pushed into the wire-receiving slots. Installation of the connector on the cable merely requires that the cable be placed on the surface 60 of the cover 54 and the connector body or housing 52 be aligned with the cable and assembled to the cover as illustrated in FIGS. 7 and 8. During such assembly, the conductors will move into the wire-receiving slots and will be received between the surface portions 32 which will establish electrical contact. The previously described lances 42 serve to retain the terminals in the cover 54. The cover may be dimensioned so that the openings 62 will support the free ends of the plate-like members in the contact section 26 against outward flexure. In other words, the contact sections 26 may be dimensioned to have an interference fit in the openings 62 so that the contact surfaces will be held against the wire by the sidewalls of the housing cover.

Terminals and connectors in accordance with the inventions can be of any desired dimensions, however, the principles of the invention offer particular advantages where the conductors are contained in a flat cable 48 and the distance between adjacent conductors 44 is extremely small. Cables 48 are now being used which have a center-to-center spacing of 0.025 inches (0.64 mm). Connectors of the type shown in FIG. 6 must also be capable of being installed on the cable 48 without stripping the insulation 48 from the cable. It follows that the terminals must be sufficiently strong to withstand the forces imposed when they are pushed through the cable insulation and when the conductors enter the terminals as shown in FIGS. 7 and 8. Terminals in accordance with the present invention are extremely robust as noted above by virtue of the fact that the bight 24 extends along one of the side edges of the shank portion and the contact surfaces 32 are immediately adjacent to the bight portion in the preferred embodiment.

It will be apparent from the foregoing description that an electrical terminal has been described which can be produced from stock metal of substantial thickness and which nonetheless is capable of being produced with extremely narrow wire-receiving slots so that a sturdy and durable terminal can be manufactured which is capable of being used with extremely fine wires.

I claim:

1. A multicontact electrical connector of the type comprising an insulating housing having a cable-receiving face, a plurality of electrical terminals in the housing, each of the terminals extending beyond the cable-receiving face and having a free end which is spaced from the cable-receiving face, each terminal having a conductor-receiving slot extending inwardly from the free end, the connector being characterized in that:

each of the terminals has a shank portion comprising a folded piece of conductive sheet metal having a bight and first and second flat side-by-side parallel spaced apart plate-like members extending from the bight, the free end being one end of the shank portion, the shank portion having an inner end which is within the housing, the shank portion having first and second side edges which extend from the inner end to the free end, the bight being on the first side edge and having one bight end which is spaced from the free end, the bight extending from the one bight end towards the inner end, the shank portion having a conductor-receiving section which extends from the free end towards the one bight end, the conductor-receiving slot being the space between the plate-like members in the conductor-receiving section.

2. A multicontact electrical connector as set forth in claim 1 characterized in that the bight of each terminal is contained within the housing so that a conductor can be moved into the wire-receiving slot and against the cable-receiving face.

3. A multicontact electrical connector as set forth in claim 2 characterized in that the plate-like members have opposed internal surfaces, the opposed internal surfaces having contact surface portions in the contact section of the shank portion, the contact surface portions extending towards the inner end of the shank portion from a location which is spaced inwardly from the free end.

4. A multicontact electrical connector as set forth in claim 3 characterized in that the opposed internal surfaces are recessed from the contact surface portions.

5. A sheet metal electrical terminal of the type comprising a shank portion having an inner end and a free end, oppositely facing first and second major surfaces on the shank portion between the inner end and the free end, and a wire-receiving slot extending inwardly from the free end, the terminal being characterized in that:

the shank portion comprises first and second flat plate-like members in side-by-side parallel relationship, the oppositely facing first and second major surfaces being on the first and second plate-like members respectively, the first and second plate-like members having spaced-apart first and second internal parallel surfaces which are opposed to each other, the shank portion having first and second side edges which extend from the free end to the inner end, the shank portion comprising a folded section of sheet metal having a U-shaped cross section comprising a bight and walls extending from the bight, the bight extending along the first side edge, the walls being the first and second plate-like members;

the bight having one end which is spaced from the free end, the bight extending from the one end thereof towards the inner end of the shank portion;

the wire-receiving slot comprising the space between the first and second internal surfaces and extending from the free end to the one end of the bight, the first and second internal surfaces having opposed contact surface portions which are spaced-apart by a distance which is less than the diameter of a wire for which the terminal is intended whereby, a wire can be connected to the terminal by aligning the wire with the slot and moving the wire laterally of its axis and into the slot.

6. A sheet metal electrical terminal as set forth in claim 5 characterized in that the opposed contact surface portions extend from a location adjacent to, but spaced from, the free end to a location adjacent to the one end of the bight, the first and second internal surfaces being recessed from the opposed contact surface portions and being spaced apart by a distance which is greater than the spacing between the opposed contact surface portions whereby the wire-receiving slot has a lead-in portion extending from the free end to the contact surface portions.

7. A sheet metal electrical terminal as set forth in claim 6 characterized in that the opposed contact surface portions extend parallel to the side edges.

8. A stamped and formed electrical terminal as set forth in claim 7 characterized in that the contact surface portions extend beside the first side edge.

9. A stamped and formed electrical terminal as set forth in either of claims 5 or 8 characterized in that the terminal is mounted in an insulating housing, the housing having a conductor-receiving face, the terminal having a projecting portion which contains the wire-receiving slot and which projects beyond the conductor-receiving face with the free end of the terminal spaced from the conductor-receiving face.

10. A stamped and formed electrical terminal as set forth in claim 9 characterized in that the insulating housing has a plurality of terminals mounted therein in spaced-apart relationship, the housing and the terminals constituting a multicontact connector.

11. A stamped and formed electrical terminal as set forth in claim 10 characterized in that the terminals in the housing are arranged in at least two rows, the terminals in each row being in side-by-side spaced-apart relationship with their plate-like portions in parallel planes, the terminals in one row being offset relative to terminals in the other row, the connector being intended for use on a flat multiconductor cable.

12. A stamped and formed electrical terminal as set forth in claim 11 characterized in that an insulating cover for the conductor-receiving face is provided, the cover having openings therein for the projecting portions of the terminals, the openings having ribs therein which enter the wire-receiving slots in the terminals when the cover is assembled to the housing.

* * * * *